US006764203B2

(12) United States Patent
Chan

(10) Patent No.: US 6,764,203 B2
(45) Date of Patent: Jul. 20, 2004

(54) STRUCTURE OF TABLE LAMP

(76) Inventor: Teng-Chiung Chan, 53-1, Hu Shan Street, Yen Chu Village, Hua Tan Hsiang, Changhua (TW)

( * ) Notice: Subject to any disclaimer, the term of this patent is extended or adjusted under 35 U.S.C. 154(b) by 0 days.

(21) Appl. No.: 10/294,812

(22) Filed: Nov. 15, 2002

(65) Prior Publication Data

US 2004/0095766 A1 May 20, 2004

(51) Int. Cl.[7] ..... F21S 8/06

(52) U.S. Cl. ..... 362/414; 362/431; 362/395; 362/285

(58) Field of Search ..... 362/414, 410, 362/285, 431, 394, 395

(56) References Cited

U.S. PATENT DOCUMENTS 5,101,332 A * 3/1992 Hsia ..... 362/401
5,141,325 A * 8/1992 Huang ..... 362/413
5,158,361 A * 10/1992 Huang ..... 362/414
5,339,233 A * 8/1994 Yang ..... 362/402
6,113,250 A * 9/2000 Lin ..... 362/287

* cited by examiner

*Primary Examiner*—Alan Cariaso
*Assistant Examiner*—Ali Alavi
(74) *Attorney, Agent, or Firm*—Rabin & Berdo, P.C.

(57) ABSTRACT

A structure of table lamp applied in table lamps to provide electric power for lighting the bulb. Teflon wires extend from the circuit device under the base surface, into supporting tubes for connection with conduction heads, so forming the first section of circuit. Electric wires, which are installed in the soft slide rails in the left and the right of an extension tube that extends between the two supporting tubes, extend to the top of the extension tube to pin joint with a bulb under the lampshade, so forming the second section of circuit. With up-and-down movements of the extension tube, the electric wires contact conductuction heads to form a galvanic circle. Therefore, inconvenience and complication of structure design are effectively reduced, and simplified structure and convenience of assembly and production are reached to improve the total productivity.

4 Claims, 6 Drawing Sheets

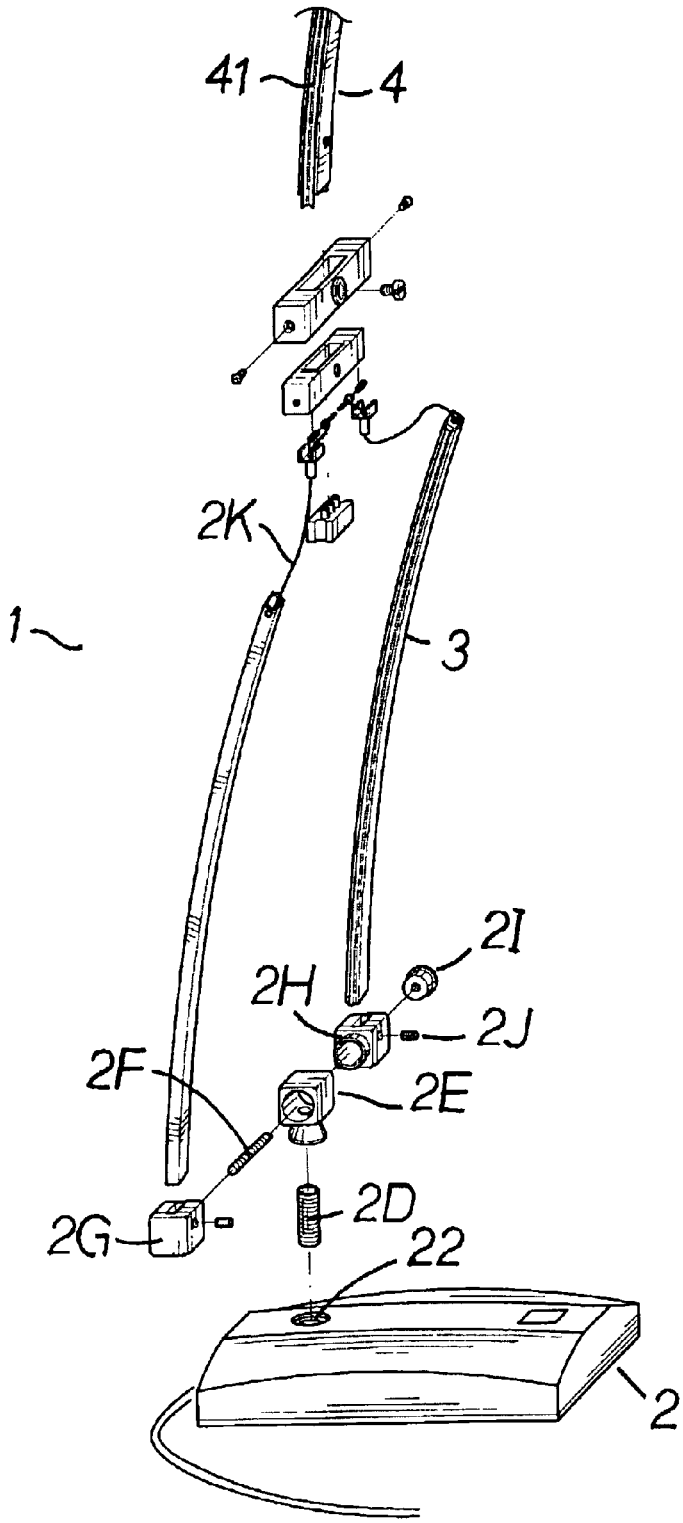
FIG. 1-A

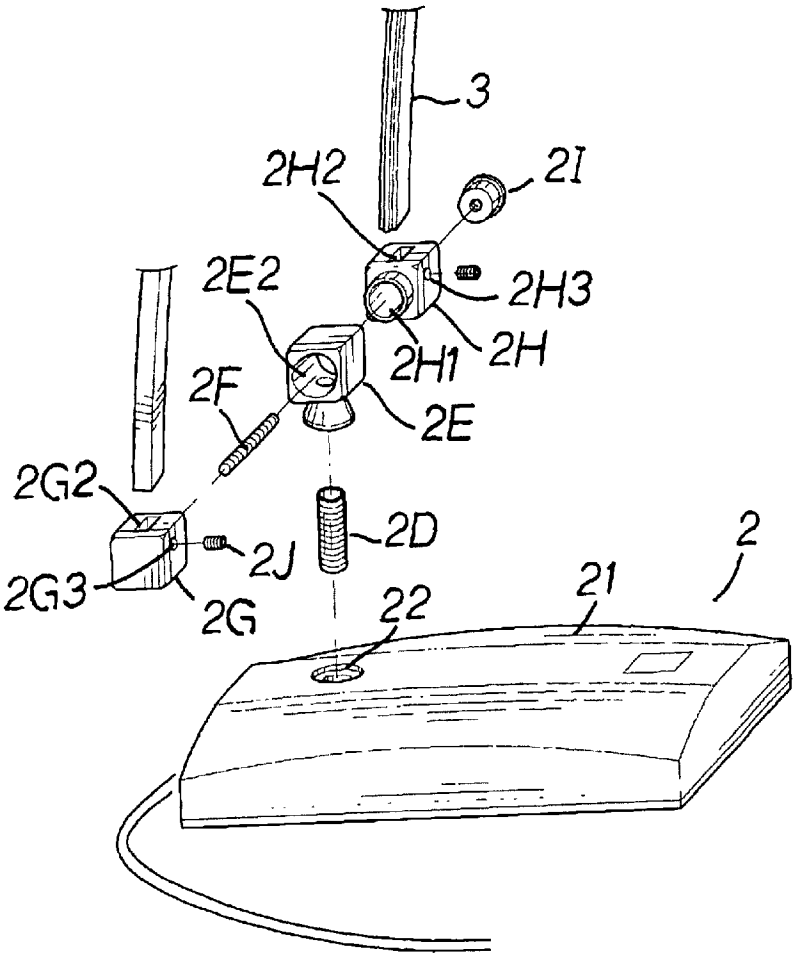
FIG. 1–B

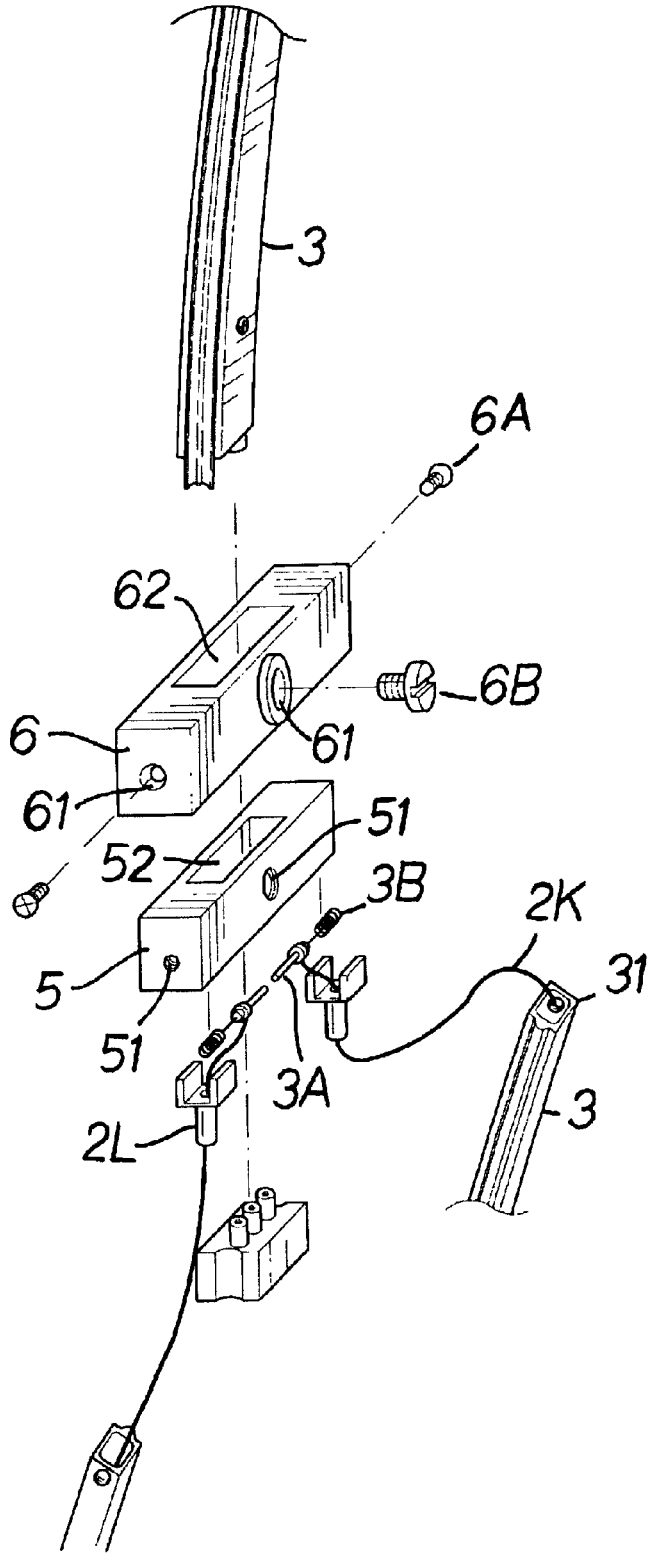
FIG. 1-C

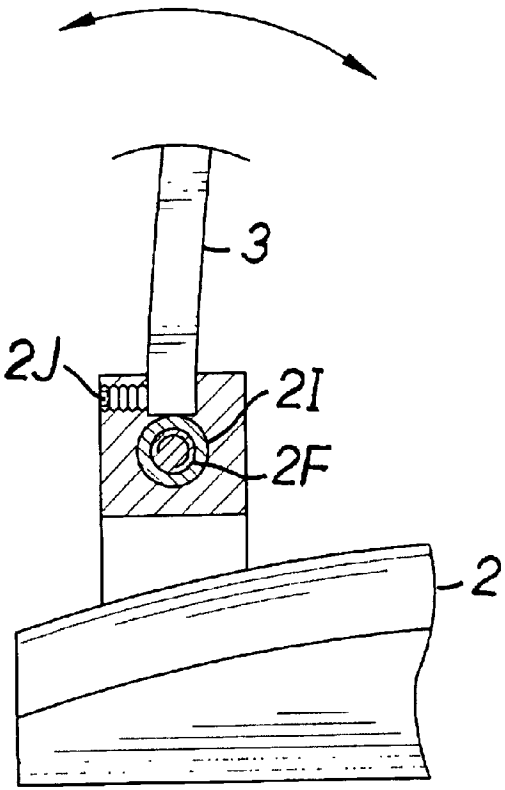
FIG. 2–B
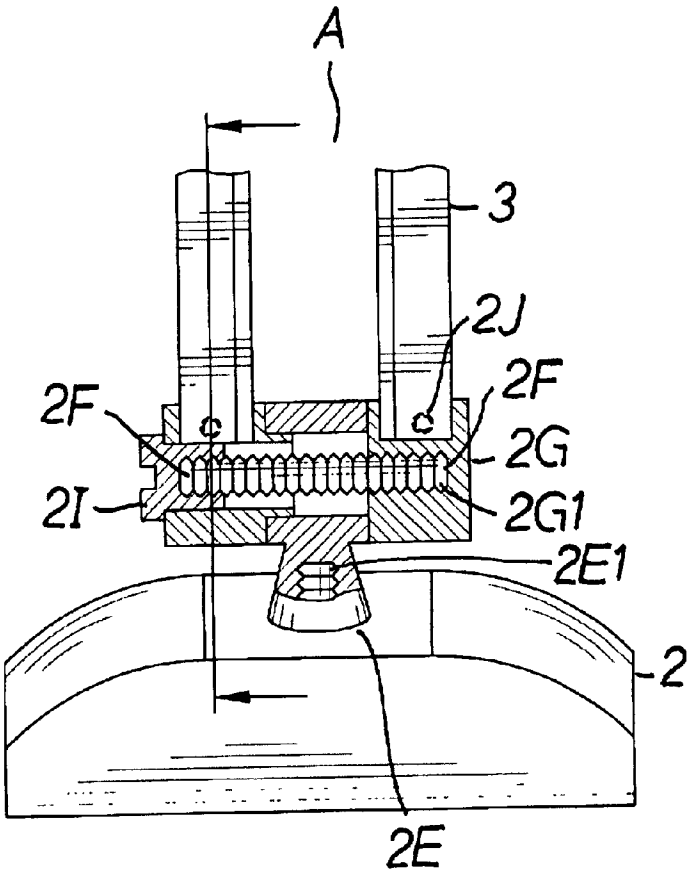
FIG. 2–A

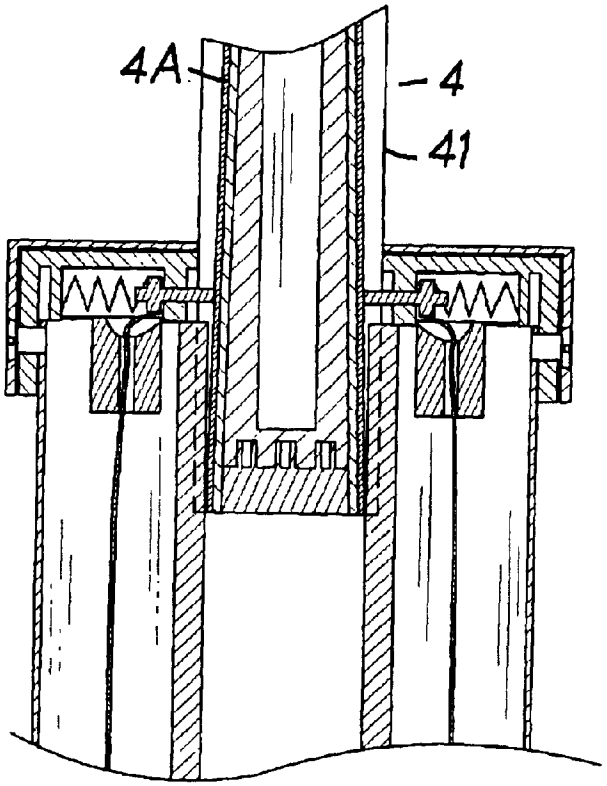
FIG. 3–B
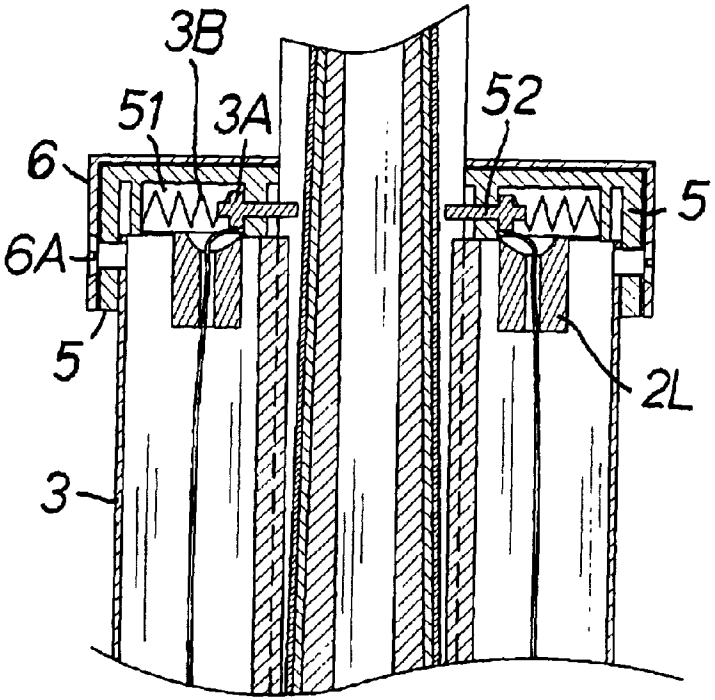
FIG. 3–A

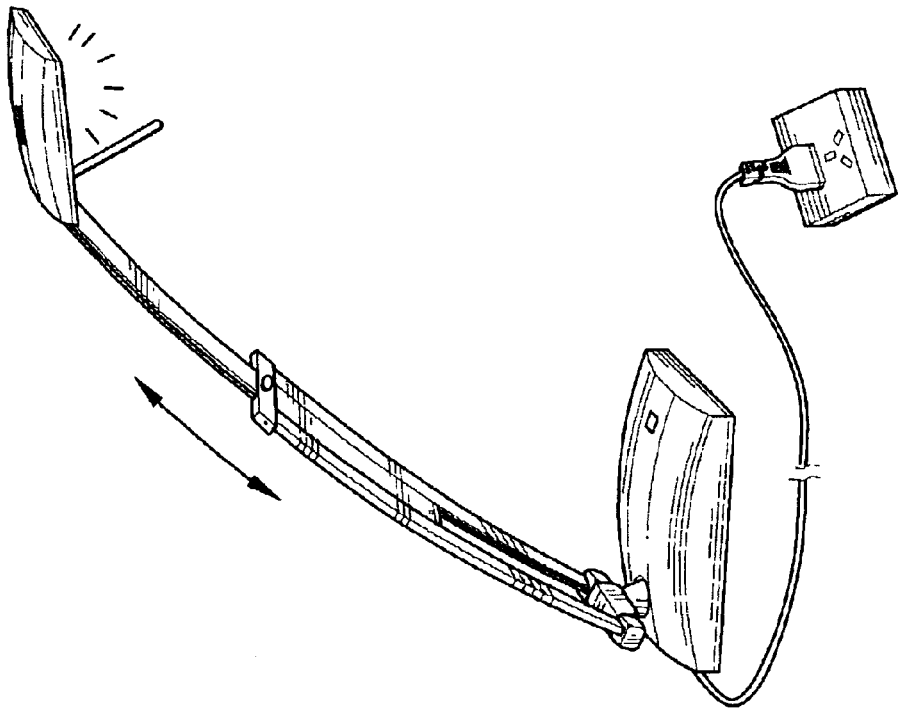
FIG. 4–B
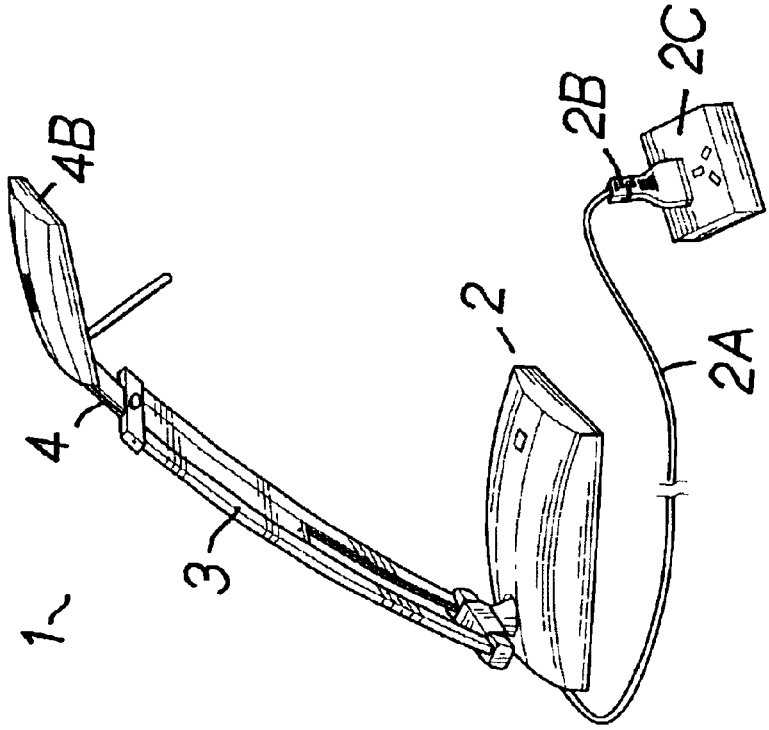
FIG. 4–A

STRUCTURE OF TABLE LAMP

DESCRIPTION OF THE INVENTION

The present invention provides a structure of a table lamp, which will not be affected by circuit layout. An extension tube extends into a long slide way between the two supporting tubes, and extends out from the long slotted hole throughout the top surface of the integrated inner and outer casing body. And moves up and down along the soft railway by using the long slotted hole as axle hole, the pair of supporting tubes as slide way, so as to adjust the lighting angle of the bulb under the lampshade, and provide user with convenience.

Generally, the structure of common lamps sold in the market is composed of a base, a supporting pole that is set on the base and enables users to make angular adjustment, and a bulb under a lampshade that is installed on the top of the supporting pole. When adjusting rotation angle of the supporting pole, the lampshade turns simultaneously. The pin joint location of lampshade with supporting pole can also turn to provide the best angle required by various look angles for convenience of usage.

However, electric power needed for lighting a table lamp is usually supplied by configuring positive and negative power cords. That is to extend positive and negative power cords from the base through the supporting pole for connection with the bulb under the lampshade, so as to provide electric power for the bulb to use. Such a method makes it necessary to put aside space for installing positive and negative power cords while designing the whole structure of table lamp, increasing inconvenience and complexity of structure design, unable to have the convenience of simplification. It also brings inconvenience to assembly and production, as well as difficulty of improving the whole productivity. In addition, wires are not covered at pin joint locations between lampshade and supporting tube, between base and supporting pole. Therefore, the lamp can not be perfectly beautiful.

Additionally, although a method of directly installing positive and negative power cords outside the whole lamp can be employed to improve the aforesaid inconveniences; it still has the shortcomings of being inaesthetic and reducing the total value of table lamp. And because positive and negative power cords are directly exposed, they are likely to be damaged easily, resulting in safety problems.

At the same time, affected by positive and negative power cords, the supporting pole only can make angular adjustments, but can't be extended or shortened. Because once it is extended or shortened, positive and negative cords inside the supporting pole will be prolonged or contracted simultaneously. So, due to repeated pull and extrusion, power cords are likely to be broken or direct short may take place, causing difficulties for supplying electric power normally. With consideration of the above shortcomings arising from the above structure, the proposer has researched this subject with great concentration based on experiences of many years engaged in lamp manufacturing and feedback results from marketing. Finally, he worked out the lamp structure of the present invention. Here the proposer applies for the new type patent. Thereinto, The main purpose of the present invention is to provide a structure of table lamp. The extension tube extends into the long slide way between the pair of supporting tubes, and extends out from the long slotted hole through the integrated inner and outer casing body on the ends of the two supporting tubes. And makes up-and-down movements along the soft railway by using the long slotted hole as axle hole and using the pair of supporting tubes as slide way, so as to turn on and turn off the lamp.

Hereinafter, characteristics of the improved structure of the present invention are explained in detail cooperated with drawings for reference of appraisal. Thereinto,

BRIEF DESCRIPTION OF THE DRAWINGS

FIG. 1-A is a stereo breakdown drawing (A) of the structure of the present invention, FIG. 1-B is a stereo breakdown drawing (B) of the structure of the present invention, FIG. 1-C is a stereo breakdown drawing (C) of the structure of the present invention, FIG. 2-A is an assembly sectional view (A) of local structure of the present invention, FIG. 2-B is a side sectional view (B) of the aforesaid local structure, FIG. 3-A is an assembly sectional view (A) of local structure of the present invention, FIG. 3-B is a side sectional view (B) of the aforesaid local structure, FIG. 4-A is an implementary example drawing (A) when the structure of the present invention doesn't extend out, FIG. 4-B is an implementary example drawing (B) when the structure of the present invention extends out.

DETAILED DESCRIPTION OF THE INVENTION

At first, please refer to FIGS. 1-A, -B, -C, FIGS. 2-A, -B, and FIGS. 3-A, -B. As shown in these figures, the structure of table lamp is composed of a base 2, a pair of supporting tubes 3 and an expansion tube 4.

The base 2 has an electric wire 2A extending therefrom. Plugged into an outlet 2C, plug 2B of the electric wire 2A is used to conduct electricity to power the lamp. As shown in FIGS. 1-A and 1-B, there is an axle hole 22 in the middle of the base surface 21. Bolt 2D is inserted into the axle hole 22 and extends out from the base surface 21 in an upright way. The exposed end of bolt 2D is inserted and locked into the screw hole 2E1 on the end of a hold-fast seat 2E, so as to fix the hold-fast seat 2E tightly on the bolt 2D. An axle hole 2E2 is made horizontally throughout the hold-fast seat 2E, and a cross shaft 2F is inserted in the axle hole 2E2 and its two ends extend outside. One end of cross shaft 2F is locked into the screw hole 2G1 in the side face of a transfer seat 2G. While the other end of cross shaft 2F is inserted into the hole 2H1 in the side face of the other transfer seat 2H, and is locked by a screw cap 2I. Thus, the two transfer seats, 2G and 2H, are seperately locked on the two ends of the cross shaft 2F, and can be rotated by using the cross shaft 2F as a rotating shaft. There are through jacks 2G2, 2H2 and lockholes 2G3, 2H3 in the top surface and side faces of the two transfer seats 2G, 2H. Jacks 2G2 and 2H2 are used for the pair of supporting tubes 3 of the same diameter to be closely inserted into them in an upright way. Screws 2J are locked into lockholes 2G3 and 2H3 to fix the pair of supporting tubes 3 into the jacks 2G2 and 2H3, so as to combine transfer seats 2G, 2H and the supporting tubes 3 into a whole unit. Therefore, the unit is able to rotate with the transfer seats 2G, 2H by using the cross shaft 2F as a rotating shaft, which makes it convenient to adjust the pair of supporting tubes into an oblique angle. The Teflon wires 2K, which extend from a circuit device under the base surface 21, are inserted into the hold-fast seat 2E at the end of bolt 2D, and then enter the two supporting tubes through the transfer seat 2G, 2H to connect with conduction heads 3A.

The two supporting tubes 3 are closely inserted in jacks 2G2 and 2H2 on top surfaces 2G and 2H of the pair of transfer seats in an upright way, forming a long slide way A for the extension tube 4 to extend into it. The ends 31 of the pair of supporting tubes 3 are covered by the inner and outer casing bodies 5 and 6 in order. The inner casing body 5 is put inside the outer casing body 6 to form a unit and spans between the ends 31 of the supporting tubes 3. Corresponding screw holes 51 and 61 are drilled in the two end faces and one side face of the integrated inner and outer casing body 5 and 6, and screws 6A and 6B are locked into the screw holes 51, 61, and tightly press the pair of supporting tubes 3. So the integrated inner and outer casing body 5, and 6 is fixed between the two ends of the pair of supporting tubes 3 as a whole. Grooves 51 are made in the two sides of the inner casing body 5 to set up conduction heads 3A and spring 3B. A small hole 52 is drilled through the inner side of the groove 51, and the conduction head 3A comes through the small hole 52 and extends out of the inner side of the supporting tube 3. The conduction heads 3A are connected to the Teflon wires 2K installed inside the supporting tubes 3. Before connecting with the conduction head 3A, the Teflon wires 2K first come through the nonconductor 2L installed inside the notch of the groove 51, so as to ensure safety and prevent electricity leakage. Corresponding slotted holes 52, 62 throughout the integrated inner and outer casing body 5 and 6 are just used for the extension tube 4, which extends into the long slide ways 52, 62 of the pair of supporting tubes 3, to extend out for convenience to make movements. The extension tube 4 is fixed by the screw 6B, which is locked into the screw hole 61 drilled on one side face of the integrated inner and outer casing body 5, 6.

The soft railways 41 are set in the left and the right of the extension tube 4, enabling the extension tube 4 to move up and down along the pair of supporting tubes 3. Installed inside the soft railways 41 and extending to a pin joint with the bulb under the lampshade 4B installed on the top of the extension tube 4, the electric wires 4A can move up and down with the extension tube 4 to contact the conduction heads 3A, so as to form a galvanic circle to conduct electricity for lighting the bulb under the lampshade on the top of the extension tube 4.

Secondly, please refer to FIGS. 4-A, -B. The extension tube 4 extends into the long slide way A formed between the pair of supporting tubes 3, and extends out from the long slotted holes 52, 62 through the top surface of the integrated inner and outer casing body 5, 6 installed on the end 31 of the pair of supporting tubes 3. This allows the tube 4 and railways 41 to make up-and-down movements by using the long slotted hole 52, 62 as an axle hole, and the pair of supporting tubes 3 as a slide way. Further, the electric wires are spaced further away from each other toward a lower end of the esxtension tube, and spaced closer to each other further up the extension tube. When the extension tube 4 extends out completely, the electric wires 4A installed on the soft railways in the left and the right of the extension tube 4 will connect to the conduction heads 3A, to form a galvanic circle to provide electricity for lighting the bulb under the lampshade 4B installed on the top of the extension tube 4.

Contrarily, when the extension tube 4 is drawn back into the long slide way A of the pair of supporting tubes 3, the electric wires 4A in the soft railways in the left and the right of the extension tube 4 will disconnect with the conduction heads 3A, and form an open circuit, and will be unable to provide electricity for lighting the bulb under the lampshade 4B installed on the top of the extension tube 4.

Thus, in the structure of table lamp 1 of the present invention, the electric power for lighting the bulb is supplied in the following way: the Teflon wires 2K installed in the circuit device under the surface 21 of the base 2, extend into the hold-fast seat 2E at the end of bolt 2D through the bolt 2D inserted in the axle hole 22, and then go through transfer seats 2G, 2H in the left and the right of the hold-fast seat 2E into the supporting tubes 3 and connect with the conduction heads 3A, so forming the first section of circuit. And then the electric wires 4A in the soft railways in the left and right of the extension tube 4, which extends in the long slide way A between the two supporting tubes 3, extends to pin joint with the bulb under the lampshade installed on the top of the extension tube 4, so forming the second section of the circuit. The wires connect with or depart from the conduction heads 3A along with the up-and-down movements of the extension tube 4, so as to light or turn off the bulb under the lampshade 4B installed on the top of the extension tube 4. By using this technical method, it is not necessary to set aside space for the first and the second section of circuit when designing the whole structure of table lamp. Therefore, simplified structure and convenience of assembly and production can be reached to improve the total productivity. And parts of circuit at locations of pin joint between lampshade 4B and the pair of supporting tubes 3, and between the base 2 and the supporting tubes 3 are also contained inside the table lamp 1 and not exposed outside. Therefore, the table lamp is perfectly beautiful.

At the same time, the structure of table lamp 1 of the present invention, without being affected by circuit layout, makes the extension tube 4 extend into the long slide way A between the two supporting tubes 3, and extend out from the long slotted hole 52, 62 throughout the top surface of the integrated inner and outer casing body 5, 6 installed on the end 31 of the supporting tubes 3. So it is able to move up and down along the soft railway 41 by using the long slotted hole 52, 62 as axle hole and the pair of supporting tubes 3 as slide way. So it is easy to adjust the lighting angle of the bulb under the lampshade 4B, providing user with great convenience.

From the above description, it can be understood that the present method can avoid inconveniences of common lamps and provide convenience and practicality for users. The present invention meets requirements of practicality and advancement for new type patents. Therefore, please do the favor to approve the present invention to be a legal patent.

What is claimed is:

1. A table lamp, comprising:

a base having an upper surface, and an axle hole formed in the upper surface;

an upright bolt inserted into the axle hole and extending out from the upper surface;

a holdfast seat having a screw hole disposed at a bottom thereof, an upper end of said bolt being inserted into the screw hole and locked in place so that said holdfast seat is fixed on said bolt, said holdfast seat further having a horizontal axle hole;

a cross shaft inserted into the horizontal axle hole, and having two ends extending out from opposite sides of the horizontal axle hole;

a first transfer seat having a screw hole on a side thereof, one of the two ends of said cross shaft being inserted into and locked to the screw hole of the first transfer seat, said first transfer seat further having a jack formed in an upper surface thereof, said first transfer seat also having a lockhole formed in a side face thereof that receives a first lock screw;

a second transfer seat that receives another one of the two ends of said cross shaft therein, said second transfer seat further having a jack formed in an upper surface thereof, said second transfer seat also having a lockhole formed in a side face thereof that receives a second lock screw, said first and second transfer seats being rotatable about an axis of said cross shaft;

a screw hole cap that is engaged with said second transfer seat and locked to the another one of the two ends of said cross shaft;

a first supporting tube having a lower end received within the jack of said first transfer seat, and being fixed within said first transfer seat using the first lock screw;

a second supporting tube having a lower end received within the jack of said second transfer seat, and being fixed within said second transfer seat using the second lock screw, said first and second supporting tubes being spaced apart from each other, and collectively forming a slideway therebetween;

an outer casing body having a slotted hole formed therein;

an inner casing body disposed within said outer casing body, and being fixed to said outer casing body to form a unit that is fixed to, and spans between, upper ends of said first and second supporting tubes, said inner casing body having a slotted hole formed therein, and which is in alignment with the slotted hole of said outer casing body, so that the unit has a slotted hole therein, said inner casing body further having first and second grooves disposed on opposite sides of the slotted hole, each of the grooves being defined by a respective wall that is adjacent to the slotted hole, each wall having a hole formed therein that communicates each respective groove with the slotted hole;

a first electric wire that extends from said base, through said upright bolt, through said holdfast seat, through said first transfer seat, and through said first supporting tube, respectively, to extend from the upper end of said first supporting tube;

a second electric wire that extends from said base, through said upright bolt, through said holdfast seat, through said second transfer seat, and through said second supporting tube, respectively, to extend from the upper end of said second supporting tube;

a first conduction head electrically coupled to said first electric wire at the upper end of said first supporting tube, and being disposed within the first groove, and having a portion that passes through the respective hole in the respective wall, to project into the slotted hole;

a second conduction head electrically coupled to said second electric wire at the upper end of said second supporting tube, and being disposed within the second groove, and having a portion that passes through the respective hole in the respective wall, to project into the slotted hole;

first and second springs disposed within the respective grooves, that respectively urge the first and second conduction heads in a direction toward the slotted hole;

first and second insulating members disposed in the respective first and second grooves, the first and second electric wires respectively passing through the first and second insulating members prior to coupling to said respective first and second conduction heads;

a light fixture; and an extension tube slidably disposed within the slotted hole, and being fixable to the unit of said inner casing body and said outer casing body using a screw, said extension tube having a left railway and a right railway, which respectively engage with said first and second supporting tubes to allow said extension tube to slide in the slideway, said light fixture being disposed on an upper end of said extension tube, and each railway having an electric wire disposed therein that extends to the light fixture, said electric wires within said railways being slidably electrically engagable with the respective conduction heads, to allow power to be transmitted to said lamp shade.

2. The table lamp recited in claim 1, wherein said electric wires within said railways are spaced farther apart from each other in a lower region of said extension tube, and are spaced closer together to each other in an upper region of said extension tube, so that when said extension tube is slid upwardly in the slideway, said electric wires within the railways electrically engage with the respective conduction heads, to provide the power to said lamp shade, and when said extension tube is slid downwardly in the slideway, said electric wires within the railways move away from the respective conduction heads to electrically disengage therewith, so that no power is provided to said lamp shade.

3. A table lamp, comprising:

a base;

a first supporting tube, and a second supporting tube coupled to said first supporting tube, said first and second supporting tubes being spaced apart from each other, and collectively forming a slideway therebetween, said first and second supporting tubes being pivotal relative to said base;

a unit that is fixed to, and spans between, upper ends of said first and second supporting tubes, said unit having a slotted hole therein;

a first electric wire that extends from said base, and through said first supporting tube, to extend from the upper end of said first supporting tube;

a second electric wire that extends from said base, and through said second supporting tube, to extend from the upper end of said second supporting tube;

a first conduction head electrically coupled to said first electric wire at the upper end of said first supporting tube;

a second conduction head electrically coupled to said second electric wire at the upper end of said second supporting tube;

a light fixture; and an extension tube slidably disposed within the slotted hole, said extension tube having a left railway and a right railway, which respectively engage with said first and second supporting tubes to allow said extension tube to slide in the slideway, said light fixture being disposed on an upper end of said extension tube, and each railway having an electric wire disposed therein that extends to the light fixture, said electric wires within said railways being slidably electrically engagable with the respective conduction heads, to allow power to be transmitted to said lamp shade.

4. The table lamp recited in claim 3, wherein said electric wires within said railways are spaced farther apart from each other in a lower region of said extension tube, and are spaced closer together to each other in an upper region of said extension tube, so that when said extension tube is slid upwardly in the slideway, said electric wires within the railways electrically engage with the respective conduction heads, to provide the power to said lamp shade, and when said extension tube is slid downwardly in the slideway, said electric wires within the railways move away from the respective conduction heads to electrically disengage therewith, so that no power is provided to said lamp shade.

* * * * *